US010512816B2

(12) United States Patent
Newman

(10) Patent No.: US 10,512,816 B2
(45) Date of Patent: Dec. 24, 2019

(54) HANDLE FOR JUMP ROPE

(71) Applicant: RX SMART GEAR, INC., El Cajon, CA (US)

(72) Inventor: David R. Newman, El Cajon, CA (US)

(73) Assignee: RX SMART GEAR, INC., El Cajon, CA (US)

( * ) Notice: Subject to any disclaimer, the term of this patent is extended or adjusted under 35 U.S.C. 154(b) by 81 days.

(21) Appl. No.: 15/425,832

(22) Filed: Feb. 6, 2017

(65) Prior Publication Data

US 2018/0221703 A1 Aug. 9, 2018

(51) Int. Cl.
*A63B 21/00* (2006.01)
*A63B 5/20* (2006.01)

(52) U.S. Cl.
CPC ..... *A63B 21/4035* (2015.10); *A63B 5/20* (2013.01)

(58) Field of Classification Search
CPC ... A63B 21/4035; A63B 5/20; A63B 21/4039; A63B 71/0054; A63B 2209/00
USPC ..... 482/82
See application file for complete search history.

(56) References Cited

U.S. PATENT DOCUMENTS 4,093,211 A 6/1978 Hughes et al.
4,158,457 A 6/1979 Hydro
4,281,832 A 8/1981 Quinby
4,330,118 A 5/1982 Race
5,071,118 A 12/1991 Barnett
5,419,563 A * 5/1995 Abrams ..... A63B 69/3632 473/202
5,478,297 A 12/1995 Dennis
5,697,871 A 12/1997 Landfair
5,749,812 A 5/1998 Feciura et al.
6,440,043 B1 8/2002 LaCoste
6,551,222 B1 4/2003 Beaver
6,736,763 B1 5/2004 Hsu
(Continued)

FOREIGN PATENT DOCUMENTS

KR 10-0340237 B1 6/2002

OTHER PUBLICATIONS gofit.net, "Jump Ropes." https://web.archive.org/web/20120306170107/http://store.gofit.net/category-s/27.htm. Available online on Mar. 6, 2012; retrieved on May 24, 2014.
(Continued)

*Primary Examiner* — Andrew S Lo
(74) *Attorney, Agent, or Firm* — Procopio, Cory, Hargreaves & Savitch LLP; Lisel M. Ferguson; Rosie H. Kim

(57) ABSTRACT

A jump rope handle has a hollow handle member with a through bore and a swivel assembly mounted in a swivel mounting portion extending up to one open end of the handle bore. The swivel assembly includes a shoulder bolt having an enlarged head and a shaft having a smooth, unthreaded outer surface extending from the enlarged head to the open end of the handle bore, an end connector or nut secured to the shaft and located outside the bore, and first and second rotatable bearings mounted between the smooth outer surface of the shaft and the handle bore to allow for relatively free rotation of the shoulder bolt in the handle bore. The end connector has a cross-hole or the like for connection to one end of a jump rope and the jump rope is easily rotatable relative to the handle via the swivel assembly during skipping activity.

18 Claims, 5 Drawing Sheets

(56) References Cited

U.S. PATENT DOCUMENTS

| | | | | |
|---|---|---|---|---|
| 6,752,746 | B1 | 6/2004 | Winkler et al. | |
| 7,086,951 | B2 * | 8/2006 | Chang | F41B 15/00 463/47.5 |
| 7,341,544 | B2 | 3/2008 | St. George et al. | |
| 7,789,809 | B2 | 9/2010 | Borth et al. | |
| 7,794,369 | B1 | 9/2010 | Rivera, III | |
| 7,914,426 | B1 | 3/2011 | Lie | |
| 8,075,455 | B2 | 12/2011 | Gamboa et al. | |
| 8,136,208 | B2 | 3/2012 | Borth et al. | |
| 9,381,391 | B1 | 7/2016 | Welty, II | |
| 9,320,932 | B2 | 8/2016 | Newman | |
| 9,687,687 | B2 * | 6/2017 | Carpinelli | A63B 5/20 |
| 2004/0002408 | A1 | 1/2004 | Rigas | |
| 2006/0035761 | A1 | 2/2006 | Saint George et al. | |
| 2007/0191194 | A1 | 8/2007 | Joy et al. | |
| 2010/0160116 | A1 | 6/2010 | LaTour | |
| 2010/0240501 | A1 | 9/2010 | Joy et al. | |
| 2011/0306474 | A1 | 12/2011 | Gamboa et al. | |
| 2013/0040786 | A1 | 2/2013 | Heinrich | |
| 2013/0165299 | A1 | 6/2013 | Hunt | |
| 2014/0080680 | A1 | 3/2014 | Henniger et al. | |
| 2015/0119206 | A1 * | 4/2015 | Newman | A63B 5/20 482/82 |
| 2015/0335931 | A1 | 11/2015 | Jordan et al. | |
| 2016/0067536 | A1 * | 3/2016 | Carpinelli | A63B 5/20 482/82 |

OTHER PUBLICATIONS

Gofit.Net, "Jump Ropes." https://web.archive.org/web/20120303053741/http://store.gofit.net/category-s/26.htm. Available online on Mar. 3, 2012; retrieved on May 21, 2014.

Gofit.Net, "Jump Ropes." https://web.archive.org/web/20120306170106/http://store.gofit.net/category-s/26.htm. Available online on Mar. 6, 2012; retrieved on May 21, 2014.

International Search Report and Written Opinion for related International Application No. PCT/US2014/061238, dated Jan. 15, 2015, in 16 pages.

International Search Report and Written Opinion for related International Application No. PCT/US2018/016036, dated Apr. 5, 2018, in 7 pges.

* cited by examiner

HANDLE FOR JUMP ROPE

BACKGROUND

Related Field

The subject matter discussed herein relates generally to jump ropes used for both exercise and play, and is particularly concerned with a jump rope handle.

Related Background

Jump ropes generally consist of a rope or cable with handles at its opposite ends and are used for skipping by adults and children, both as a recreation or as a high performance aerobic or cardiovascular exercise. In my prior U.S. Pat. No. 9,320,932, a high performance exercise jump rope is described which comprises a cable attached at opposite ends to handles via a swivel assembly.

Skipping or jumping rope routines are common and popular for both play and exercise. In particular, athletes and others commonly use rope skipping or jumping in high performance exercise or workout routines for conditioning purposes. Jump rope exercising is also popular as a cross-training exercise which can be performed at different intensity and skill levels. Jump rope handles with swivel attachment to the rope or cable allow the rope to swivel or turn about its central longitudinal axis relative to the handle during skipping. In general, a jump rope handle should have a comfortable grip which resists slipping, and a swivel attachment to the rope which allows smooth swiveling of the cable or rope.

SUMMARY

According to one aspect, a jump rope handle is provided which comprises a hollow handle member of metal or other rigid material having a bore and opposite first and second ends, the bore having a swivel mounting portion extending to the second end of the handle member, and a swivel assembly mounted in the swivel mounting portion of the bore, the swivel assembly comprising a shoulder bolt having an enlarged head, a shaft having a smooth, unthreaded outer surface of a first diameter extending from the enlarged head to the second end of the handle member, an end connector or end nut secured to the shaft and located outside the bore at the second end of the handle member, the end connector having a cross-hole or other connecting device for connection to one end of a jump rope, and first and second rotatable bearings mounted between the smooth outer surface of the shaft and the handle bore and configured for allowing substantially free rotation of the shoulder bolt in the handle bore.

In one embodiment, the shoulder bolt has a smaller diameter end portion projecting out of the handle bore and the end cap has a bore in which the end portion engages to secure the end cap to the shoulder bolt by means of adhesive, threaded engagement, or the like.

In one embodiment, the handle is formed of metal or other rigid material and the bore is a through bore extending between the first and second ends, with the first end being open to reduce the overall handle weight. In one embodiment, the handle has an outer surface with a plurality of spaced annular grooves, and a corresponding number of resilient O-rings are engaged in respective annular grooves with each O-ring projecting partially out of the respective groove to form grips for a user gripping the handle.

Other features and advantages will become more readily apparent to those of ordinary skill in the art after reviewing the following detailed description and the accompanying drawings.

DETAILED DESCRIPTION

Figure 1:
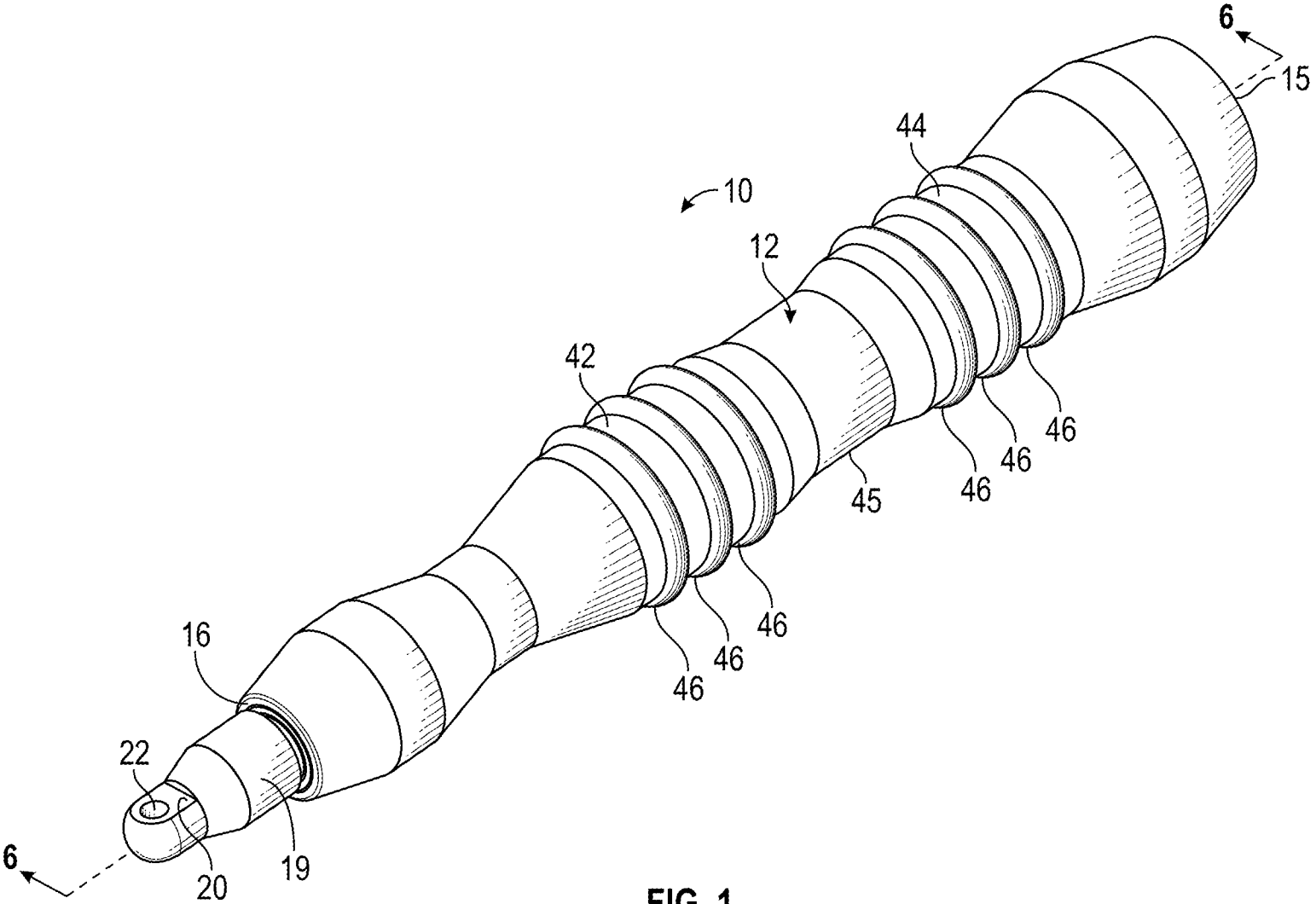
FIG. 1 is a perspective view of one embodiment of a jump rope handle.
Figure 2:
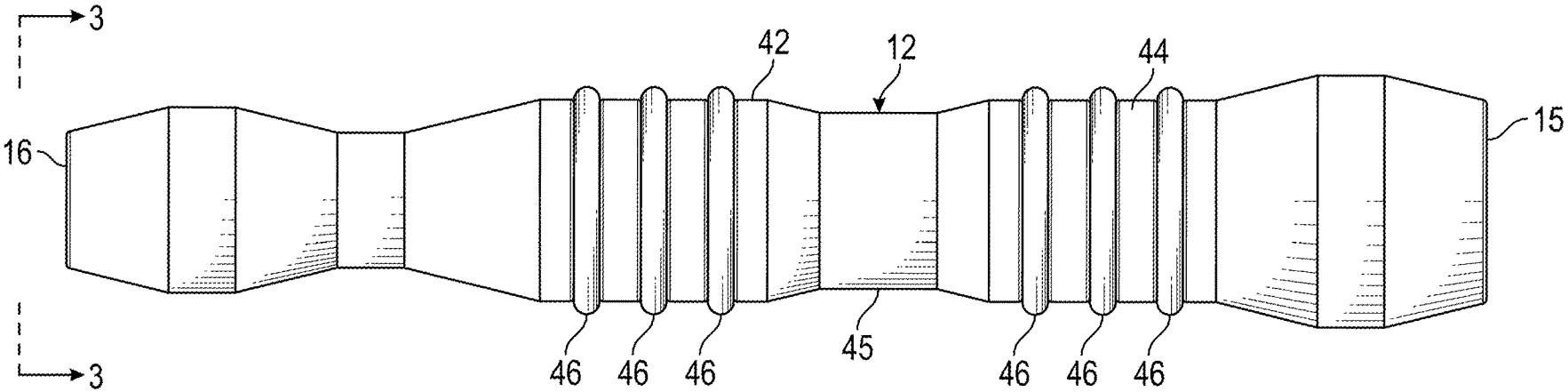
FIG. 2 is a left side elevation view of the jump rope handle member of FIG. 1 with the end cap of FIG. 1 omitted, the right side being a mirror image thereof.
Figure 3:
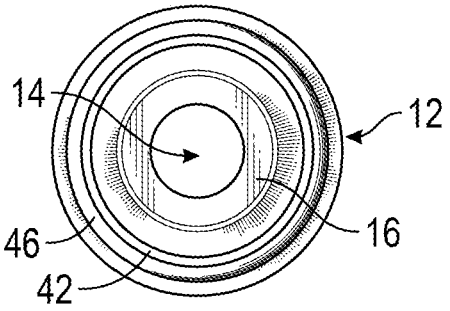
FIG. 3 is an end elevation view of the handle member of FIG. 2, in the direction 3-3 of FIG. 2.
Figure 4:
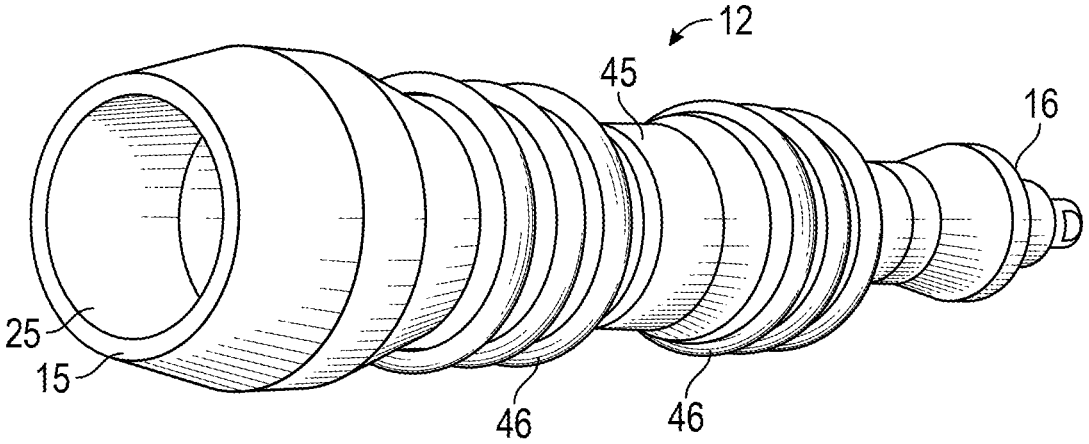
FIG. 4 is an outer end perspective view of the jump rope handle of FIG. 1.

The subject matter described herein is taught by way of example implementations. Various details have been omitted for the sake of clarity and to avoid obscuring the subject matter. The examples shown and described below are directed to a jump rope handle with a swivel assembly for smooth rotation of an attached jump rope about the longitudinal axis of the rope during skipping.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

FIGS. 1 to 6 illustrate a jump rope handle 10 adapted for connection to one end of a jump rope or cable with the other end of the jump rope attached to an identical handle. In the illustrated embodiment, handle 10 comprises a handle member 12 having an internal bore 14 and first and second ends 15, 16, and a swivel assembly 18 rotatably engaged in an end portion of the internal bore and having an end nut or connector 19 outside the second end 16 of the handle member. End connector 19 has a generally cylindrical portion with a flattened outer end portion 20 having a cross hole 22 extending transverse to the longitudinal axis of the swivel assembly. An end of a jump rope or cable may be secured to end connector 19 via hole 22 in any suitable manner, for example via a cable connector as described in my U.S. Pat. No. 9,320,932, the contents of which are incorporated herein by reference. Alternatively, the end of a jump rope or cable may be simply extended through hole 22 and retained by means of a knot or stop on the end of the rope. Other devices for connecting the jump rope to the swivel assembly. A suitable fixed cap 25 may be secured in the outer or first end 15 of the handle member to close the through bore 14.

Figure 5:
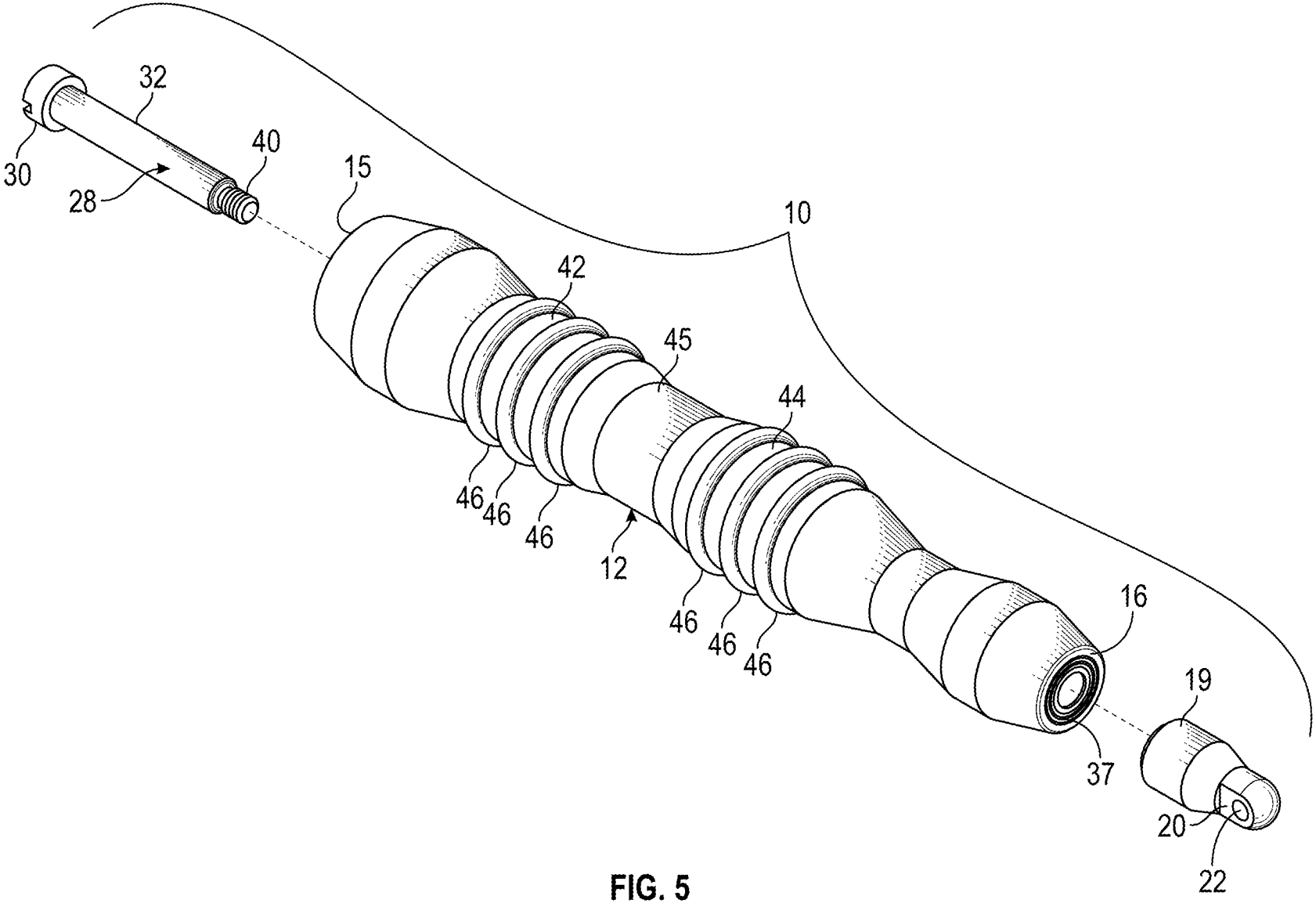
FIG. 5 is an exploded view illustrating the separated parts of the jump rope handle of FIG. 1.
Figure 6:
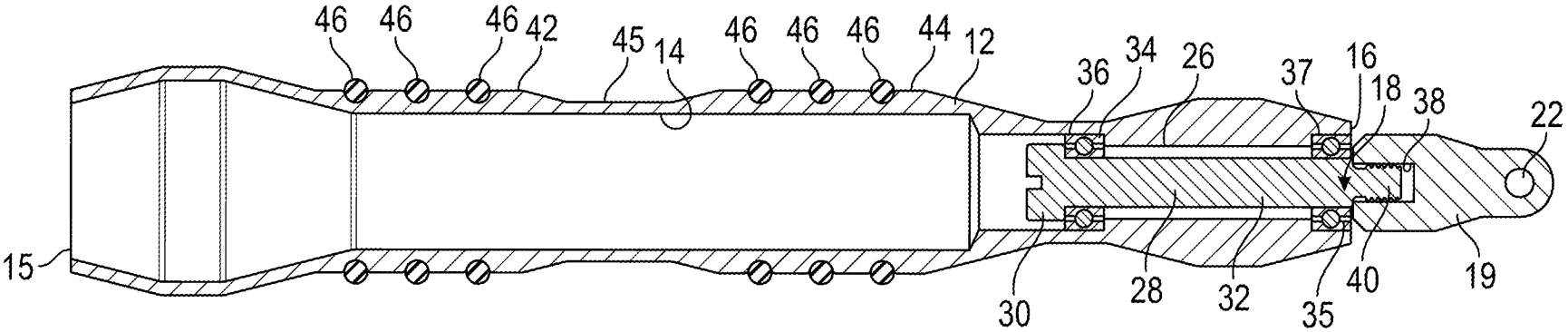
FIG. 6 is a cross-sectional view of the jump rope handle on the lines 6-6 of FIG. 1.

As best illustrated in FIGS. 1, 5 and 6, handle member 12 is hollow and bore 14 is a through bore with an open outer end 25 at the first end 15 of the handle. In one embodiment, the majority or main part of handle member 12 is of relatively lightweight but strong metallic material such as aluminum alloy or stainless steel. The use of a rigid and relatively high strength material allows the handle walls to be relatively thin, as seen in FIG. 6. Additionally, leaving the outer end open with no end cap further reduces the overall handle weight. Through bore 14 is of stepped diameter, and has an end portion 26 in which the swivel assembly 18 is seated. Swivel assembly 18 basically comprises a shoulder bolt 28 having an enlarged head 30, a shaft 32 having a smooth, unthreaded outer surface extending from the enlarged head through bore end portion 26 to the end 16 of the handle member, and end connector or nut 19 secured to the shaft 32 and located outside the bore at the second end 16 of the handle member. First and second identical rotatable bearings 34, 35 are mounted between the smooth outer surface of shaft and stepped seats 36, 37 in bore end portion 26. Bearings 34 and 35 are configured for allowing substantially free and smooth rotation of the shoulder bolt in the handle bore. In one embodiment, the bearings 34, 35 may be Annular Bearing Engineering Committee (ABEC) class 7 precision bearings. As illustrated in FIG. 6, end connector or nut 19 has a threaded bore 38 at its inner end, and a reduced diameter, threaded end portion 40 projects from the smooth internal portion of the shaft and is in threaded engagement in bore 38 to rigidly secure connector 19 to shaft 32. In alternative embodiments, shaft 32 may be secured to connector 19 by other fastening means such as adhesive or welding, but the threaded engagement outside the handle bore 14 allows for separation of the parts as in FIG. 5 for both initial installation and maintenance purposes.

In the illustrated embodiment, the outer surface of the handle member is also of stepped diameter, and includes spaced portions 42, 44 of substantially equal diameter and a small, reduced diameter waist portion 45 between portions 42, 44. Each portion 42, 44 has a set of three spaced grooves 45, and a respective elastomeric or rubber O-ring 46 is seated in each of the grooves. As seen in FIGS. 1, 2, 5 and 6, the O-rings 46 extend out of the respective grooves to provide gripping formations for the user's hand. The use of O-ring grips instead of outer elastomeric gripping inserts or sleeves further reduces the weight of the jump rope handles and makes them easy to use in a jump rope assembly. The combination of smooth metal and rubber O-rings and the overall outer handle shape of FIGS. 1 and 2 also creates an aesthetically pleasing, ornamental external appearance to the handle member.

In one embodiment, the length of the handle member 12 was around 5.0 to 5.5 inches, the largest diameter portion of the outer surface had a diameter of around 0.9 to 1.0 inches, the smallest diameter of the swivel mounting portion 26 had a diameter of around 0.30 inches, and the swivel bearing seats 36 and 37 had a diameter of around 0.39 to 0.40 inches.

The smooth shoulder bolt 28 of the swivel assembly that both bearings rest upon in the above embodiment creates tighter tolerance and relatively high performance which is enhanced by having an end connector or head for attachment to the rope or cable which is located completely outside the handle bore. This allows for fast and smooth swiveling or rotation of the attached rope or cable relative to the handle.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter that is broadly contemplated by the present invention. It is further understood that the scope of the present invention fully encompasses other embodiments that may become obvious to those skilled in the art and that the scope of the present invention is accordingly limited by nothing other than the appended claims.

What is claimed:

1. A jump rope handle, comprising:

a hollow handle member having a bore and opposite first and second ends, the bore having a swivel mounting portion extending through part of the bore to the second end of the handle member, wherein the bore comprises a first portion, a second portion, and a third portion, wherein the first portion has a first length with a first diameter that is smaller than a second diameter of the second portion and a third diameter of the third portion, wherein the first portion has a circular cross-section, wherein a first stepped seat is formed by the first and second portions, and wherein a second stepped seat is formed by the first and third portions; and a swivel assembly positioned in the swivel mounting portion of the bore, the swivel assembly comprising:

a shoulder bolt having an enlarged head and a shaft having a smooth, unthreaded outer surface of a fourth diameter extending from the enlarged head to the second end of the handle member, and an outer end portion having a fifth diameter that is smaller than the fourth diameter;

an end connector secured to the outer end portion and located outside the bore at the second end of the handle member, the end connector being configured for connection to one end of a jump rope; and first and second rotatable bearings positioned on opposite ends of the first portion of the bore, wherein the first rotatable bearing is seated in the first stepped seat and within the second portion of the bore, wherein the second rotatable bearing is seated in the second stepped seat and within the third portion of the bore, wherein each of the first and second bearings is positioned between the smooth, unthreaded outer surface of the shoulder bolt and the bore and allows for substantially free rotation of the shoulder bolt in the handle member bore, and wherein the first and second bearings and the first portion are sized and configured to receive the shaft such that only the shaft having the smooth, unthreaded outer surface extends within the first portion of the bore.

2. The jump rope handle of claim 1, wherein the end connector has a cross-hole for connection to one end of a jump rope.

3. The jump rope handle of claim 1, wherein the outer end portion projects from the shaft out of the handle member bore, and wherein the end connector has a bore in which the end portion engages to secure the end connector to the shoulder bolt.

4. The jump rope handle of claim 3, wherein the outer end portion and end connector bore have matching threaded formations for threaded engagement between the shoulder bolt and end connector.

5. The jump rope handle of claim 1, wherein the rotatable bearings are Annular Bearing Engineering Committee (ABEC) class 7 precision bearings.

6. The jump rope handle of claim 1, wherein the rotatable bearings are identical and the first and second bearings are in engagement with spaced portions of the shoulder bolt shaft, and the second bearing is located adjacent the second end of the handle member.

7. The jump rope handle of claim 2, wherein the end connector has a first, cylindrical portion adjacent the second end of the handle member and a second, flattened outer end portion of reduced dimensions relative to the first, cylindrical portion, and the cross-hole is located in the flattened portion.

8. The jump rope handle of claim 1, wherein the bore is a through bore and has an open outer end at the first end of the handle member.

9. The jump rope handle of claim 1, wherein the handle member comprises a main part formed of rigid material and having an outer surface, and a plurality of spaced resilient O-rings are mounted on the outer surface, the outer surface having a plurality of spaced annular grooves, each O-ring being engaged in respective annular groove and projecting partially out of the respective annular groove, whereby the O-rings form grips configured for a user to grip the handle.

10. The jump rope handle of claim 9, wherein the outer surface of the handle member is of varying diameter and has two spaced cylindrical portions spaced from the respective first and second ends of the handle member, and each cylindrical portion has a set of three grooves with three resilient O-rings seated in the respective grooves.

11. A jump rope handle, comprising:

a hollow handle member having a bore and opposite first and second ends, the bore having a swivel mounting portion extending through part of the bore to the second end of the handle member, wherein the bore comprises a first portion, a second portion, and a third portion, and wherein the first portion has a first length with a first diameter that is smaller than a second diameter of the second portion and a third diameter of the third portion, and wherein the first portion has a circular cross-section;

a swivel assembly mounted in the swivel mounting portion of the bore, the swivel assembly comprising a shoulder bolt having an enlarged head and a shaft having a smooth, unthreaded outer surface of a fourth diameter extending from the enlarged head to the second end of the handle member, and an outer end portion, an end connector secured to the outer end portion and located outside the bore at the second end of the handle member, and first and second rotatable bearings mounted on opposite ends of the first portion of the bore, wherein the first rotatable bearing is positioned within the second portion of the bore, wherein the second rotatable bearing is positioned within the third portion of the bore, and wherein the first and second bearings and the first portion are sized and configured to receive the shaft such that only the shaft having the smooth, unthreaded outer surface extends within the first portion of the bore, and allows for substantially free rotation of the shoulder bolt in the handle member bore;

the end connector being configured for connection to one end of a jump rope;

wherein the handle member comprises a main part formed of rigid material and having an outer surface, and a plurality of spaced resilient O-rings are mounted on the outer surface, the outer surface having a plurality of spaced annular grooves, each O-ring being engaged in respective annular groove and projecting partially out of the respective annular groove, whereby the O-rings form grips configured for a user to grip the handle; and wherein the outer surface of the handle member is of varying diameter and has two spaced cylindrical portions spaced from the respective first and second ends of the handle member, and each cylindrical portion has a set of three grooves with three resilient O-rings seated in the respective grooves.

12. The jump rope handle of claim 11, wherein the end connector has a cross-hole for connection to one end of a jump rope.

13. The jump rope handle of claim 11, wherein the outer end portion is of smaller diameter than the fourth diameter and projects from the shaft out of the handle member bore, and wherein the end connector has a bore in which the end portion engages to secure the end connector to the shoulder bolt.

14. The jump rope handle of claim 13, wherein the outer end portion and end connector bore have matching threaded formations for threaded engagement between the shoulder bolt and end connector.

15. The jump rope handle of claim 11, wherein the rotatable bearings are Annular Bearing Engineering Committee (ABEC) class 7 precision bearings.

16. The jump rope handle of claim 11, wherein the rotatable bearings are identical and the swivel mounting portion of the bore has spaced, first and second bearing seats in which the respective first and second bearings are seated, the first and second bearings are in engagement with spaced portions of the shoulder bolt shaft, and the second bearing is located adjacent the second end of the handle member.

17. The jump rope handle of claim 12, wherein the end connector has a first, cylindrical portion adjacent the second end of the handle member and a second, flattened outer end portion of reduced dimensions relative to the first, cylindrical portion, and the cross-hole is located in the flattened portion.

18. The jump rope handle of claim 11, wherein the bore is a through bore and has an open outer end at the first end of the handle member.

* * * * *